US006416047B1

(12) United States Patent
Pfankuch

(10) Patent No.: US 6,416,047 B1
(45) Date of Patent: Jul. 9, 2002

(54) FRICTIONAL FEEDER FOR PAPER STACKS OR THE LIKE

(75) Inventor: Claus Karl Pfankuch, Hamburg (DE)

(73) Assignee: Pfankuch Maschinen GmbH, Ahrensburg (DE)

( * ) Notice: Subject to any disclaimer, the term of this patent is extended or adjusted under 35 U.S.C. 154(b) by 0 days.

(21) Appl. No.: 09/640,306

(22) Filed: Aug. 16, 2000

(30) Foreign Application Priority Data

May 19, 2000 (DE) ..... 200 09 086

(51) Int. Cl.[7] ..... B65H 3/04
(52) U.S. Cl. ..... 271/35; 271/165
(58) Field of Search ..... 271/35, 162, 165, 271/166, 150

(56) References Cited

U.S. PATENT DOCUMENTS 3,908,983 A * 9/1975 Long ..... 271/35
4,369,961 A * 1/1983 Gopel et al. ..... 271/35
5,244,198 A * 9/1993 Green ..... 271/35
6,050,562 A * 4/2000 Long ..... 271/35
6,050,563 A * 4/2000 Vedoy et al. ..... 271/35

* cited by examiner

*Primary Examiner*—H. Grant Skaggs
(74) *Attorney, Agent, or Firm*—Friedrich Kueffner

(57) ABSTRACT

A frictional feeder for paper stacks has a frictional conveyor belt that receives a paper stack of paper sheets from above and conveys individual paper sheets of the paper stack in a conveying direction of the feeder. A curved support is positioned above the frictional conveyor belt at a rearward end of the paper stack, viewed in the conveying direction, and at a slant relative to a plane of the paper sheets of the paper stack. It supports the rearward end of the paper stack. An elbow lever with a first end and a second end is provided, and its first end is connected to the curved support. A self-locking drive unit is connected to the second end of the elbow lever. It is provided to pivot the elbow lever and the curved support connected to the elbow lever to adjust the slant of the curved support relative to the plane of the paper sheets of the paper stack.

4 Claims, 4 Drawing Sheets

FRICTIONAL FEEDER FOR PAPER STACKS OR THE LIKE

BACKGROUND OF THE INVENTION

1. Field of the Invention

The invention relates to a frictional feeder for paper stacks or the like, comprising a frictional conveyor belt below the paper stack and a curved support on which the paper sheets of the stack rest with their rearward end and which is adjustable with respect to its slant relative to the plane of the paper sheets.

2. Description of the Related Art

Such frictional feeders are comprised of a frictional component group and a conveying component group. The frictional component group includes the frictional conveyor belt and the curved support. The curved support guides the paper sheets or similar products of the stack in cooperation with a forward curved guide into the product passage which transfers the individual paper sheets onto the conveying component group. The curved support receives a portion of the weight of the paper sheets and reduces the pressure of the paper sheets acting on the frictional conveyor belt. This is important with respect to a disturbance-free operation of the frictional feeder. Small changes or errors when adjusting the slant of the curved support can result in malfunction of the feeder.

It is already known to adjust the slant and the spacing to the plane of the frictional conveyor belt.

SUMMARY OF THE INVENTION

It is an object of the present invention to provide a frictional feeder of the aforementioned kind in which the slant of the curved support can be adjusted in a reproducible manner, independent of the force acting on the curved support, and with which a fine adjustment is possible without requiring an additional fixation of the curved support after completion of the adjusting operation.

In accordance with the present invention, this is achieved in that an elbow lever is fastened to the curved support and that the elbow lever is pivotable by means of a self-locking drive unit for the purpose of adjusting the slant of the curved support.

According to the invention an elbow lever is provided with which the curved support is connected to the self-locking drive unit. The self-locking drive unit allows an adjustment of the slant without running the risk that this adjustment, once it has been undertaken, is again changed, for example, by the weight of the paper sheets of the stack.

In an especially advantageous manner, the self-locking drive unit is comprised of a spindle drive comprising a spindle and a spindle nut. The required self-locking action is realized by providing a correspondingly minimal pitch of the thread of the spindle.

According to another preferred embodiment, the end of the elbow lever which is not acting as a support of the spindle nut, is pivotably supported on a lever arm which is also pivotably supported for adjusting the slant of the curved support.

Preferably, the stationary bearing location of the spindle is located on the pivot axis of the lever arm.

Advantageously, the curved support together with the drive unit and the bearing locations can be adjusted in the direction of the axis of the spindle. When the frictional feeder is configured in this way, a further adjusting possibility is provided in order to adjust not only the slant of the curved support but also the height of the curved support relative to the paper stack.

DESCRIPTION OF THE PREFERRED EMBODIMENTS

Figure 1:
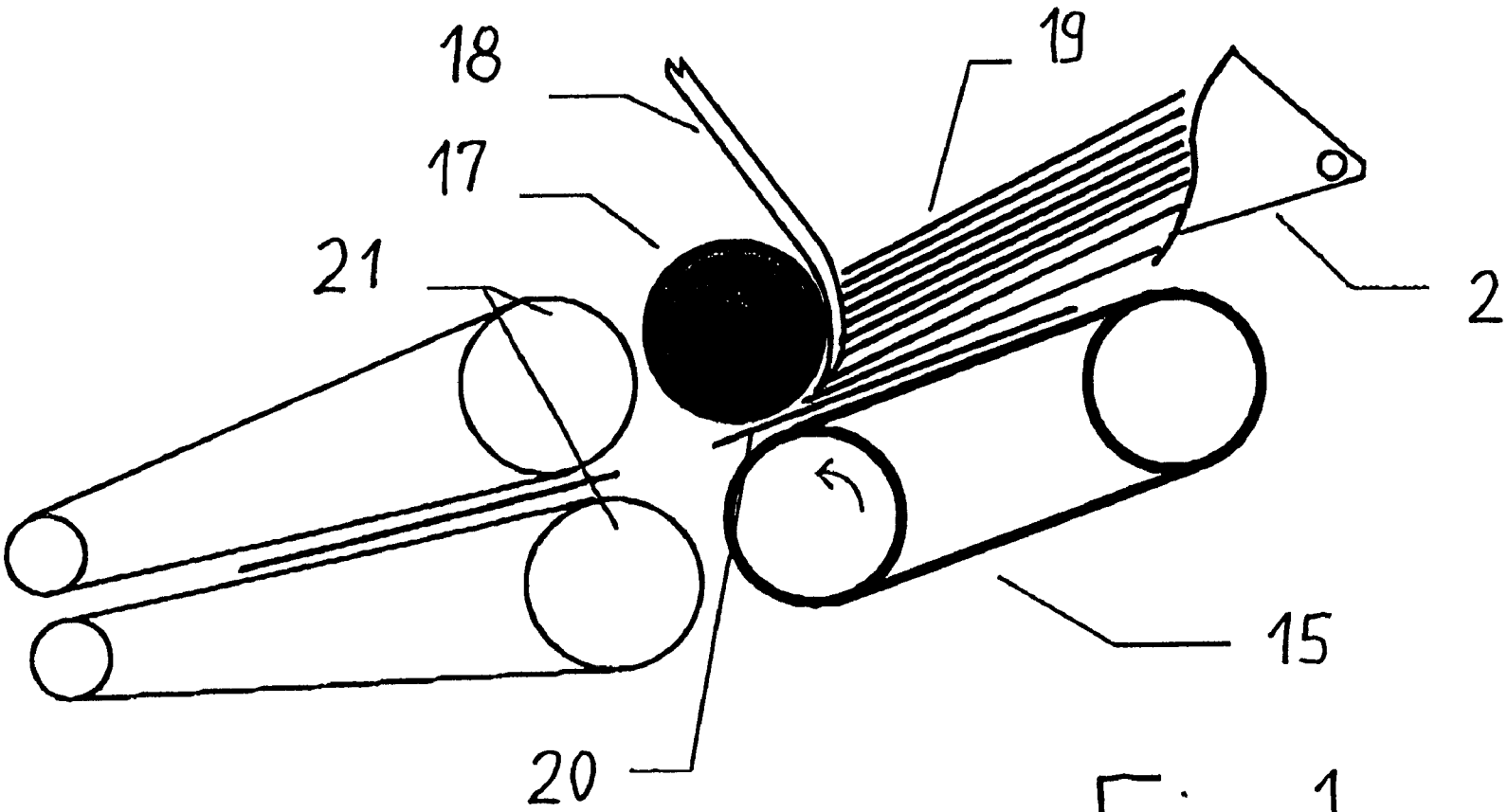
FIG. 1 is a schematic side view of a frictional feeder illustrating the essential components of such a frictional feeder.

FIG. 1 shows a frictional feeder with its essential components. The paper stack 19 rests with its lowermost paper sheet against a frictional conveyor belt 15. At its rearward end, the paper stack 19 is supported by a curved support 2 which is pivotably supported. At the front end of the paper stack 19 a curved guide 18 is provided which extends to a passage 20 between two rollers, wherein the roller 17 is a stripper roller. These parts define the frictional component group. The individualized paper sheets pass through the passage 20 in the conveying direction of the feeder and enter the conveying component group which is comprised of ejector rollers 21 and corresponding conveyor belts.

Figure 2:
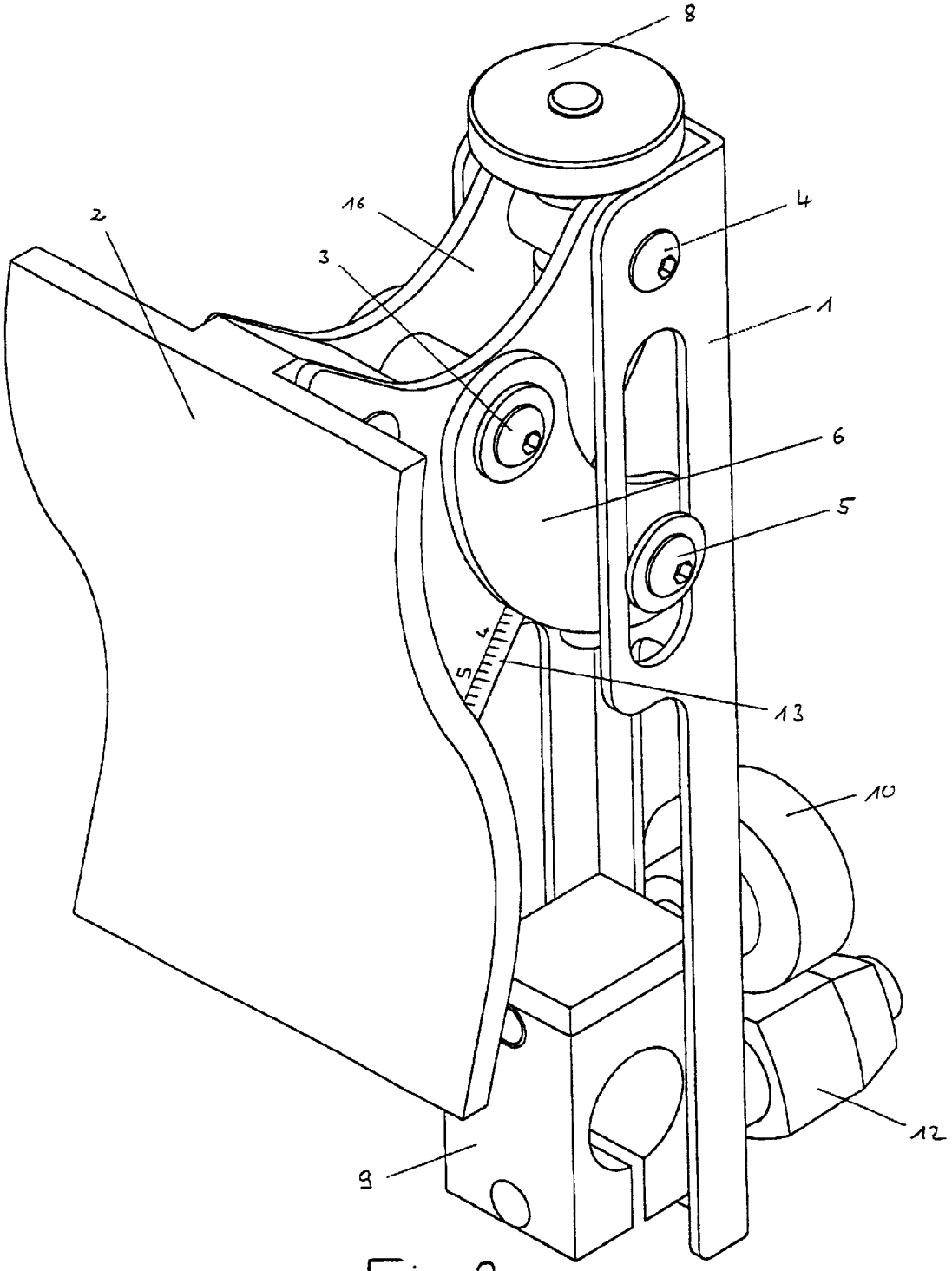
FIG. 2 is a perspective front view of the curved support and of the drive unit provided for its adjustment according to the present invention.
Figure 3:
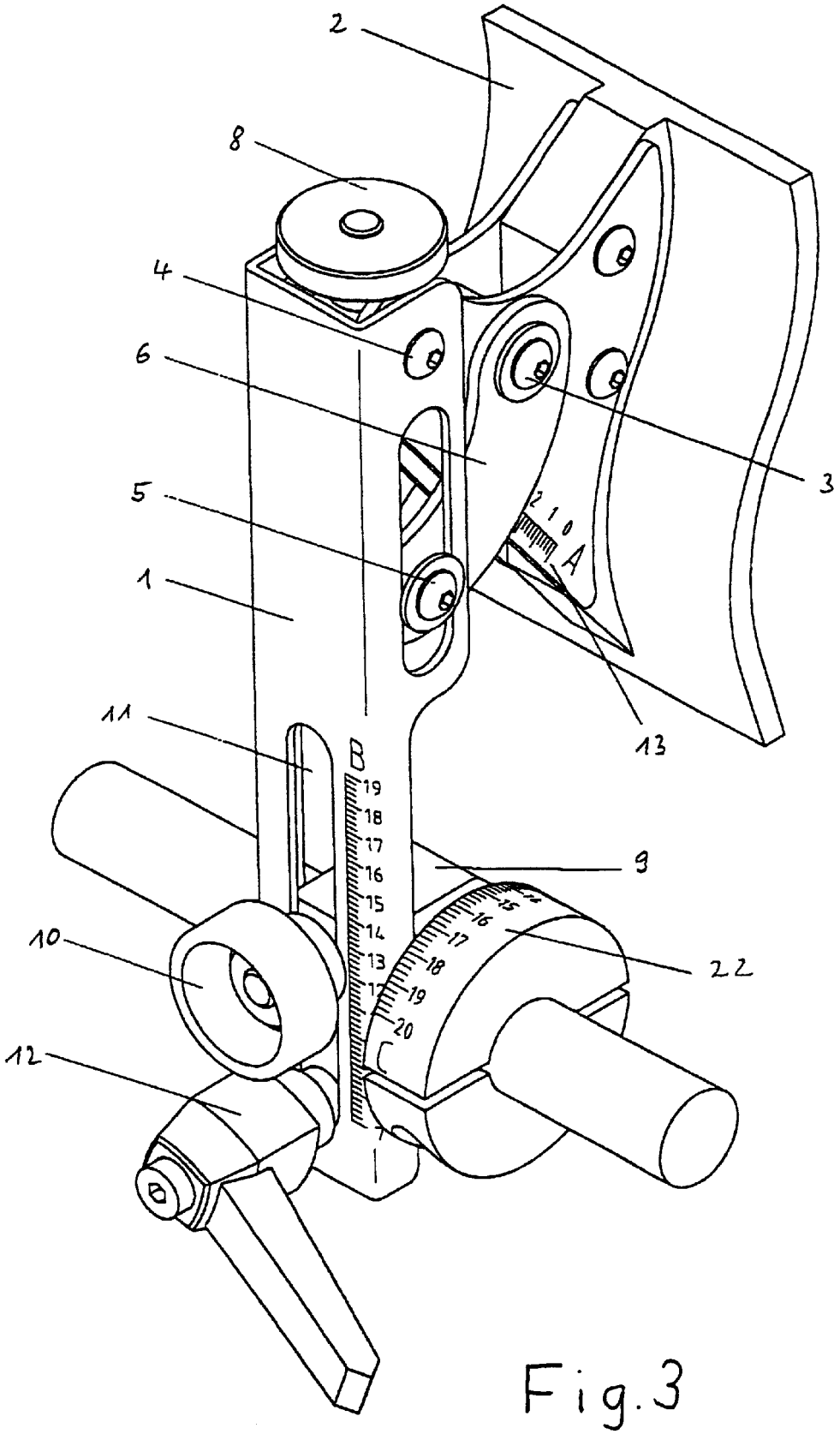
FIG. 3 is a perspective rear view of the curved support and of the drive unit according to the present invention.
Figure 4:
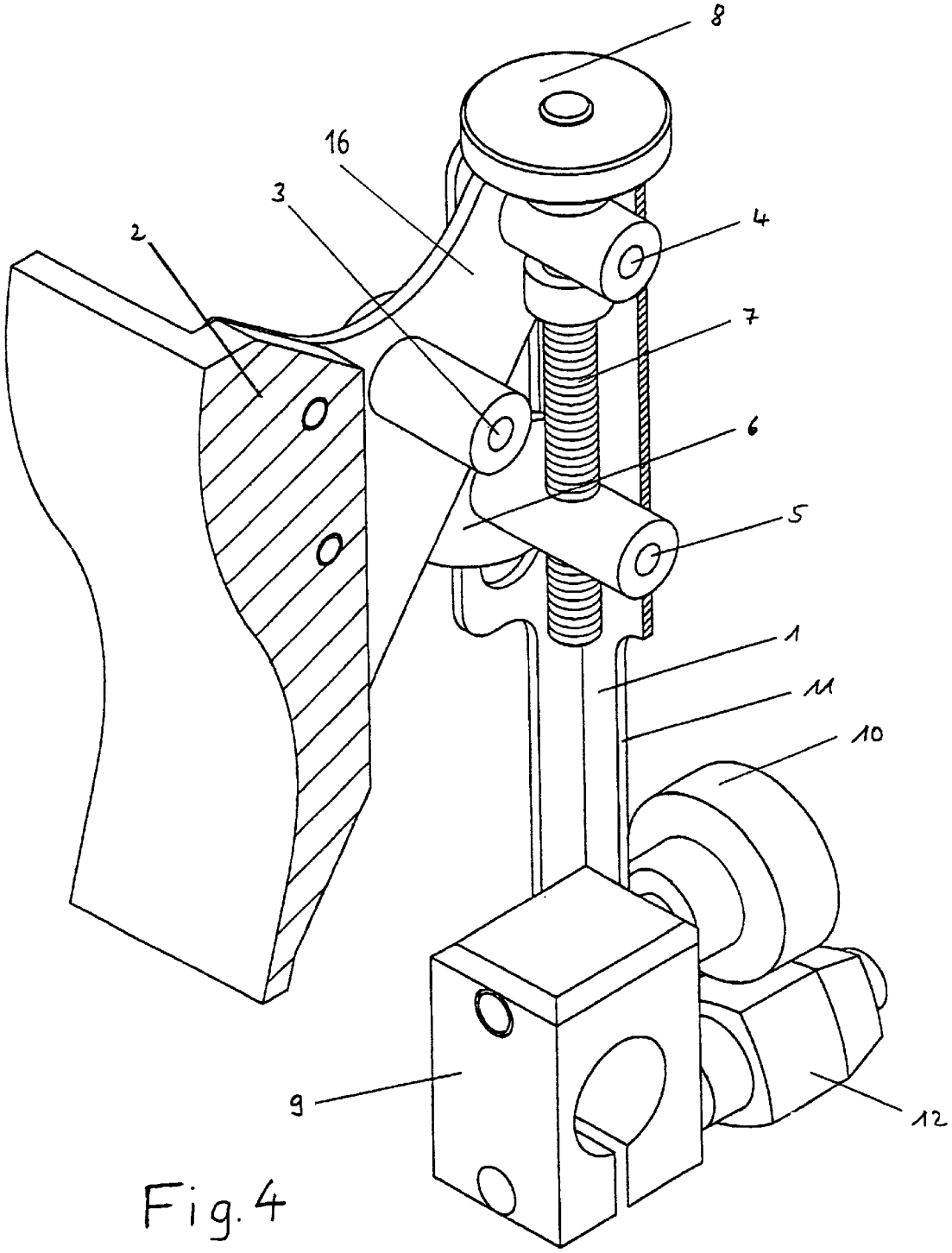
FIG. 4 is a perspective front view, partially in section, of the curved support and of the drive unit according to the present invention.

In FIGS. 2 through 4 the curved support 2 with its bearing arrangement is illustrated in detail. The actual support plate 2*a* of the curved support 2 is fastened to a lever arm 16 which is pivotably supported on the base member 1. An elbow lever 6 is pivotably fastened to the elbow lever 16 at the bearing location 3. The other end of the elbow lever 6 supports a spindle nut 5 which is pivotably supported at this end of the elbow lever 6 and is slidably arranged in the slotted hole 5*a* provided in the base member 1. On the pivot axis 4 a spindle 7 is supported on which the spindle nut 5 is seated. A knurled nut 8 is provided for rotating the spindle 7.

The base member 1 is fastened to a machine frame (not shown) by means of a clamping holder 9 which is secured and released by means of a clamping lever 12. The clamping holder 9 is adjustable relative to the base member 1 in a slotted hole 11, and a knurled nut 10 secures the respective selected positions.

Three scales or graduations 13, 14, and 22 make it possible to determine the respective position.

When the slant of the curved support 2 is to be adjusted, this is carried out by means of the knurled nut 8, i.e., by rotation of the spindle 7. Accordingly, the spindle nut 5 is moved in the direction of the rotational axis of the spindle 7 in the slotted hole 5*a* of the base member 1. The resulting pivot movement of the elbow lever 6, as a result of the change of the spacing between the bearing locations 4 and 5, causes the lever arm 16 and the support plate 2*a* of the curved support 2 to be pivoted up or down, the elbow lever 6 being pivotable about the pivot axis 3.

The entire base member 1 can be adjusted up and down by means of the clamping holder 9 and its fastening means, i.e., can be adjusted in the direction of the rotational axis of the spindle 7. For this purpose, the knurled nut 10 must be released.

The scale 14 indicates the position of the base member 1 relative to the machine frame. The scale 14 indicates the slant of the curved support 2.

The spindle drive (5, 7) is configured and dimensioned such that an easy fine adjustment is possible, that this adjustment, i.e., realized by the drive unit formed by the spindle drive (5, 7), is self-locking, so that the weight of the paper stack 19 which loads the curved support 2 cannot result in a change of the adjustment. An adjustment is possible only by actuating the knurled nut 8.

While specific embodiments of the invention have been shown and described in detail to illustrate the inventive principles, it will be understood that the invention may be embodied otherwise without departing from such principles.

What is claimed is:

1. A frictional feeder for paper stacks comprising a frictional conveyor belt configured to receive a paper stack comprised of paper sheets from above and to convey individual paper sheets of the paper stack in a conveying direction;

a curved support positioned above the frictional conveyor belt at a rearward end of the paper stack, viewed in the conveying direction, and at a slant relative to a plane of the paper sheets of the paper stack and configured to support the rearward end of the paper stack;

an elbow lever having a first end and a second end, wherein the first end is connected to the curved support;

a self-locking drive unit connected tot he second end of the elbow lever and configured to pivot the elbow lever and the curved support connected to the elbow lever to adjust the slant of the curved support relative to the plane of the paper sheets of the paper stack, wherein the drive unit is comprised of a spindle and a spindle nut, wherein the spindle nut is connected to the second end of the elbow lever, wherein the spindle nut and the second end of the elbow lever are pivotable relative to one another about a pivot axis and wherein the pivot axis is perpendicular to a rotational axis of the spindle.

2. The frictional feeder according to claim 1, wherein the curved support comprises a support plate and a lever arm projecting away from the support plate, wherein the first end of the elbow lever is pivotably connected to the lever arm wherein the lever arm is configured to pivot about an end remote from the support plate.

3. The frictional feeder according to claim 2, wherein the spindle is stationarily supported on a pivot axis of the end of the lever arm remote from the support plate.

4. The frictional feeder according to claim 3, wherein the curved support and the drive unit are configured to be adjustable in a direction of the rotational axis of the spindle.

* * * * *